United States Patent [19]

Murai

[11] 3,971,868

[45] July 27, 1976

[54] FABRIC TAPE FOR SLIDE FASTENER STRINGERS WITH MEANS TO PREVENT UNRAVELING AT ITS SEVERED ENDS

[75] Inventor: Ryukichi Murai, Toyama, Japan

[73] Assignee: Yoshida Kogyo Kabushiki Kaisha, Japan

[22] Filed: Feb. 4, 1975

[21] Appl. No.: 546,877

[30] Foreign Application Priority Data

Feb. 7, 1974 Japan ..... 49-15867[U]

[52] U.S. Cl. ..... 428/194; 24/205 R; 24/205.11 F; 156/88

[51] Int. Cl.[2] ..... A47H 1/00; A44B 19/24

[58] Field of Search ..... 24/205.11 F, 205.16 D, 24/205 R; 156/88; 428/194, 115

[56] References Cited

UNITED STATES PATENTS

| | | | |
|---|---|---|---|
| 1,356,890 | 10/1920 | Smith | 156/88 |
| 3,128,543 | 4/1964 | Fasciano | 24/205 R |
| 3,226,275 | 12/1965 | Kiess | 156/88 |
| 3,377,668 | 4/1968 | Carlile | 24/205.11 F |
| 3,490,970 | 1/1970 | Heimberger | 24/205.11 F |
| 3,616,939 | 11/1971 | Potin | 24/205.11 F |
| 3,663,996 | 5/1972 | Heimberger | 24/205.11 F |

FOREIGN PATENTS OR APPLICATIONS

| | | | |
|---|---|---|---|
| 7,102,225 | 8/1971 | Netherlands | 24/205.11 F |
| 1,067,227 | 5/1967 | United Kingdom | 24/205.11 F |
| 1,192,266 | 5/1970 | United Kingdom | 156/88 |

*Primary Examiner*—Bernard A. Gelak
*Attorney, Agent, or Firm*—Bucknam and Archer

[57] ABSTRACT

A stringer tape is made of a woven fabric the warp and/or weft of which is constituted of yarns composed of synthetic fibers or filaments or of blends of synthetic and other fibers or filaments. At each end of the stringer tape, formed by severance of the tape from a continuous length of such fabric tape, there are formed a plurality of thermally fused regions to prevent the unraveling of the fabric. The thermally fused regions are spaced from each other in the transverse direction of the tape.

2 Claims, 2 Drawing Figures

FABRIC TAPE FOR SLIDE FASTENER STRINGERS WITH MEANS TO PREVENT UNRAVELING AT ITS SEVERED ENDS

BACKGROUND OF THE INVENTION

This invention relates generally to slide fasteners, and more specifically to stringer tapes made of a fabric, especially of a woven fabric. The invention is even more specifically directed to means for preventing the unraveling of the fabric tapes at their severed ends.

In the art of slide fastener manufacture, it is customary to first produce continuous lengths of stringer tapes, which are formed in a suitable manner into a continuous length of coupled stringers or the so-called fastener chain, and then to sever the fastener chain into individual fastener lengths. During the subsequent handling or use of the manufactured slide fasteners, therefore, the fabric tapes may suffer gradual unraveling at their severed ends.

In order to prevent this, it has heretofore been practiced to cover the entire severed end portions of the fabric tapes with films or to coat the same with a suitable resin solution. These prior art methods unduly stiffen the severed end portions of the fabric tapes. When the slide fastener having such stringer tapes is attached to underwear, for example, the stiff end portions of the tapes can give the wearer not only an unpleasant sensation but, at times, an acute pain.

SUMMARY OF THE INVENTION

It is therefore an object of this invention to provide a fabric stringer tape including improved means for effectively preventing the unraveling of the fabric at the severed tape end or ends without impairing the desired flexibility of the tape.

With this and other objects in view, this invention provides, in a stringer tape which is made of a fabric at least partly including synthetic fibers or filaments and which has at least one end formed by severance of the tape from a continuous length of such fabric tape, that improvement which comprises a plurality of thermally fused regions formed at the severed end portion of the stringer tape so as to prevent the unraveling of the fabric. The thermally fused regions should be suitably spaced from each other in the transverse direction of the stringer tape.

The flexibility of the severed end portion of the stringer tape is not substantially impaired since the portion is thermally fused at the isolated regions only. Slide fasteners incorporating the stringer tapes of this invention can therefore be applied to underwear or like articles to the best advantage, as the severed end portions of the tapes will not easily pain or discomfort the wearer even when held in direct contact with the skin.

The features which are believed to be novel and characteristic of this invention are set forth in particular in the appended claims. The invention itself, however, as well as the further objects and advantages thereof, will become apparent in the course of the following description which is to be read in connection with the accompanying drawings which illustrate a preferred embodiment of the invention, and in which like reference characters denote like parts throughout.

DESCRIPTION OF THE PREFERRED EMBODIMENT

Figure 1:
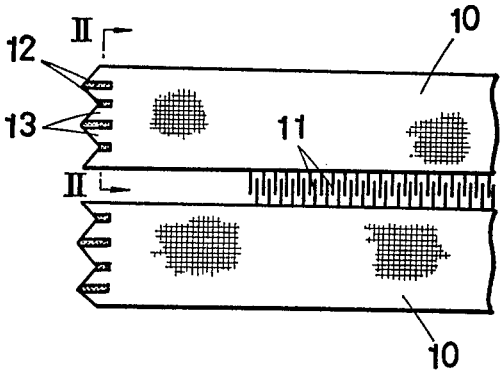
FIG. 1 is a fragmentary, schematic plan view of a pair of fastener stringers which include tapes incorporating the novel concepts of this invention.

FIG. 1 illustrates a pair of stringer tapes 10 of a woven fabric carrying rows of interlocking fastener elements 11 along their opposed longitudinal edges. Each stringer tape 10 has its left hand end, as seen in the drawing, shown to be severed in a zigzag fashion from a continuous length of such tape as by the usual severing or trimming knife and anvil that are customarily employed in the art. The right hand end of each stringer tape may be similarly severed.

The woven fabric of which the stringer tapes 10 are made is such that its warp and weft are both constituted of yarns composed of synthetic fibers or filaments or of blends of synthetic and other fibers or filaments. Alternatively, either of the warp and weft may be synthetic or partly synthetic.

In order to prevent the unraveling of the severed end of each stringer tape 10, there are formed according to the invention a plurality of thermally fused regions 12 by taking advantage of the synthetic fibers or filaments existing at the severed end portion of the strinter tape. The thermally fused regions 12 may be formed by the conventional high frequency or ultrasonic welding techniques.

Figure 2:
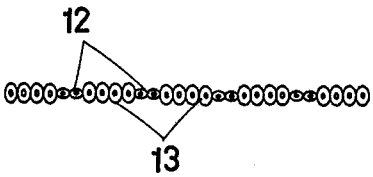
FIG. 2 is a sectional view taken along the plane of line II—II in FIG. 1.

As will be seen also from the cross sectional view given in FIG. 2, the thermally fused regions 12 have relatively wide spacings 13 alternating therewith in the transverse direction of the stringer tape 10. For the best results, each thermally fused region 12 should be suitably elongated in the longitudinal direction of the tape.

It is possible in this manner to effectively prevent the unraveling of the severed end or ends of each stringer tape. Furthermore, since the spacings 13 are left between the adjacent fused regions 12, which are relatively narrow as seen in FIG. 1, the sewing needle can easily pierce the tape. The sewing operation of the stringers to articles can therefore be carried out expeditiously.

While the stringer tape according to the invention has been shown and described hereinbefore in very specific aspects thereof, it is understood that the invention itself admits of many modifications within the broad teaching hereof. The invention, therefore, should and is intended to be construed broadly and in a manner consistent with the true spirit and scope of the invention as sought to be defined by the following claims.

What is claimed is:

1. In a slide fastener stringer tape which is made of a fabric at least partly including synthetic fibers and which has at least one end formed by severance of the stringer tape from a continuous length of such tape, the improvement comprising a plurality of separated thermally fused regions formed at the severed end portion of said stringer tape to prevent the unraveling of the fabric, said thermally fused regions being spaced apart from each other in the transverse direction of said stringer tape, in each thermally fused region, the synthetic fibers therewithin being fused to bond the fabric together.

2. The improvement of claim 1, wherein each of said thermally fused regions is elongated in the longitudinal direction of said stringer tape.

* * * * *